United States Patent [19]

Dickakian

[11] 4,427,531

[45] Jan. 24, 1984

[54] PROCESS FOR DEASPHALTENATING CAT CRACKER BOTTOMS AND FOR PRODUCTION OF ANISOTROPIC PITCH

[75] Inventor: Ghazi Dickakian, Scotch Plains, N.J.

[73] Assignee: Exxon Research and Engineering Co., Florham Park, N.J.

[21] Appl. No.: 291,990

[22] Filed: Aug. 11, 1981

[51] Int. Cl.[3] ..... C10C 1/20; C10C 1/18; C10C 3/06; C10C 3/08

[52] U.S. Cl. ..... 208/40; 208/44; 208/39; 208/96; 208/309

[58] Field of Search ..... 208/44, 40, 39, 309, 208/96

[56] References Cited

U.S. PATENT DOCUMENTS

| | | | |
|---|---|---|---|
| 2,790,754 | 4/1957 | Johnston et al. | 208/96 |
| 2,843,531 | 7/1958 | Corneil et al. | 208/96 |
| 3,919,376 | 11/1975 | Schutz | 423/447.4 X |
| 4,208,267 | 6/1980 | Diefendorf et al. | 208/45 |
| 4,240,898 | 12/1980 | Gomi | 208/44 |
| 4,277,324 | 7/1981 | Greenwood | 208/309 |

FOREIGN PATENT DOCUMENTS

| | | | |
|---|---|---|---|
| 2034343 | 7/1970 | Fed. Rep. of Germany | 208/309 |
| 2001670 | 2/1979 | United Kingdom | 208/309 |

*Primary Examiner*—Delbert E. Gantz
*Assistant Examiner*—Helane Maull

[57] ABSTRACT

A process for removing asphaltenes present in cat cracker bottoms is disclosed. Basically, the process requires removal of at least a portion of the polynuclear aromatic oils present in the cat cracker bottom, for example, by vacuum stripping, whereby the asphaltenes are thereafter capable of being extracted from the so-treated cat cracker bottom. Heat soaking of the asphaltene-free cat cracker bottom results in a pitch particularly suitable for carbon artifact manufacture.

4 Claims, No Drawings

PROCESS FOR DEASPHALTENATING CAT CRACKER BOTTOMS AND FOR PRODUCTION OF ANISOTROPIC PITCH

FIELD OF THE INVENTION

This invention is concerned generally with the preparation of anistropic pitch, and particularly with the preparation of a feedstock for carbon artifact manufacture from cat cracker residues.

BACKGROUND OF THE INVENTION

As is well known, there are vast quantities of heavy aromatic by-products produced from the steam cracking of gas oil or naphtha from the catalytic cracking of hydrocarbons and from high temperature coke production from coal. In general, these heavy aromatic by-products are composed of alkyl substituted polynuclear aromatic compounds. The heavy aromatic fractions, of course, are not uniform, but contain a complex mixture of polynuclear aromatic oils, asphaltenes and, of course, the usual quantities of impurities. These heavy aromatic by-products also vary significantly in their chemical structure and molecular weight distribution, aromatic ring distribution and coking characteristics. By coking characteristics, of course, is meant their tendency to form isotropic coke on heating to temperatures in the range of about 400° C. to about 550° C. Notwithstanding these differences, the just mentioned heavy aromatic feedstocks are used for production of pitches which have various varying microstructures (i.e., isotropic or anisotropic).

It is believed that the major portion of the heavy aromatic feedstock which is essential for the production of anisotropic pitch is the low molecular weight polynuclear aromatics present in the heavy aromatic feedstocks, i.e., with the polynuclear aromatics having aromatic rings of from about 3 to 7. These multi-ring polynuclear aromatic molecules on thermal treatment at high temperatures, for example on temperatures in the range from about 400° C. to about 500° C., undergoes several reactions, such as dealkylation, ring condensation, dimerization, trimerization and polymerization, resulting in the production of a highly aromatic pitch in which the molecules tend to align themselves in such a manner that when a polished sample of the pitch is viewed in the plane of polarized light seem to have a highly anisotropic or crystalline type of structure. Further, carbonization of such pitches tend to yield highly ordered structures which are most important in the manufacture of carbon artifacts and particularly carbon fiber and needle coke.

As indicated, however, these heavy aromatic feedstocks are complex mixtures, and, as a consequence thereof, contain significant quantities of other materials which when heated at elevated temperatures, for example, in the range of 400° C. to 500° C., result in the generation of isotropic material, such as isotropic coke which is not particularly desirable for carbon artifact manufacture, and particularly is considerably undesirable in the manufacture of carbon fibers since the presence of coke particles or, indeed, the presence of other high molecular weight components present in the resultant pitch are detrimental to spinning the pitch into fibers for subsequent carbonization. Indeed, coke particles are even believed to be detrimental to product quality and generally are responsible for breaks in the fibers, plugging of the spinneret and numerous other difficulties are associated with the presence of such quinoline insoluble substances.

To summarize some of the requirements then for a feedstock material suitable for carbon artifact manufacture, and in particular carbon fiber production, the first requirement is the ability of the feedstock to be converted to highly optically anisotropic material. Additionally, the highly optically anisotropic material should have a relatively low softening point so that they can be deformed and shaped into the desirable article. Insofar as carbon fiber manufacture is concerned, a suitable pitch which is capable of generating the requisite highly ordered structure also must exhibit sufficient viscosity for spinning. As eluded to above, many carbonaceous pitches have relatively high softening points and, indeed, with many carbonaceous pitches incipient coking occurs frequently in such materials at temperatures where they have a sufficient viscosity for spinning.

Additionally, suitable feedstock should be substantially free of coke or other infusible materials and/or undesirably high softening point components and materials likely to generate such infusible materials that are undesirably high softening point components prior to the spinning temperatures of the pitch.

Last, but not least, a suitable feedstock for carbon artifact manufacture should be able to be converted to a suitably high optically anisotropic material at a reasonable rate. For example, in U.S. Pat. No. 3,919,376, it is disclosed that 350° C. is the minimum temperature generally required to produce optically anisotropic material, mesophase, from a carbonaceous pitch. More importantly, however, is the fact that at least one week of heating is necessary to produce a mesophase content of about 40% at that minimum temperature. The mesophase, of course, can be generated in shorter times by heating at higher temperatures. However, at temperatures in excess of about 425° C. incipient coking and other undesirable side reactions do take place which can be detrimental to the ultimate product quality.

One component which is present in heavy aromatic feedstocks and which is detrimental to the production of a carbonaceous pitch suitable for carbon artifact manufacture is asphaltene. As is well known, asphaltenes are solids which are insoluble in paraffinic solvents and have high melting points, and most importantly asphaltenes tend to form isotropic coke readily because of their highly aromatic ring structure and high molecular weight. Indeed, the coking characteristics of asphaltenes can be determined by the standard analytical test used in the carbon industry (SMTTP Method No. TT-10-67). Basically in this test, a sample of asphaltene is carbonized at 550° C. for 2 hours and the resulting coke generated is determined quantitatively.

The deasphaltenation of the heavy aromatics, as is well known, is achieved by solvent extraction of the feed using typically paraffinic solvents having from 5 to 7 carbon atoms. Such a technique, however, has not been successful in deasphaltenating cat cracker bottoms to the extent that the cat cracker bottom is converted into a feedstock suitable in carbon artifact manufacture.

SUMMARY OF THE INVENTION

It has now been discovered that the asphaltene present in the cat cracker bottoms can be readily removed if the cat cracker bottom is first treated to remove the oils present in the cat cracker bottom. In the simplest sense then, the present invention contemplates a process for removing asphaltenes from cat cracker bottoms. More particularly, the present invention contemplates converting a cat cracker bottom into a feedstock suitable for carbon artifact manufacture by treating a cat cracker bottom, e.g., vacuum stripping, to remove at least a portion of the aromatic oils present in said cat cracker bottom; thereafter treating said vacuum stripped cat cracker bottom to remove at least a portion of the asphaltenes present in the cat cracker bottom thereby providing a feedstock suitable for carbon artifact manufacture.

Full appreciation of all of the ramifications in the present invention will be more readily understood upon a reading of the detailed description which follows.

DETAILED DESCRIPTION OF THE INVENTION

The term catalytic cracking refers to a thermal and catalytic conversion of gas oils, particularly virgin gas oils, boiling generally between about 316° C. and 566° C., into lighter, more valuable products.

Cat cracker bottoms refer to that fraction of the product of the cat cracking process which boils in the range of from about 200° C. to about 550° C. Cat cracker bottoms typically have relatively low aromaticity as compared with graphitizable isotropic carbonaceous pitches suitable in carbon artifact manufacture.

Specifications for a typical cat cracker bottom that are suitable in the practice of the present invention are given in Table I below.

TABLE I

| | Range |
|---|---|
| Physical Characteristics | |
| Viscosity cst at 210° F. | 1.0–10.0 |
| Ash content, wt. % | 0.010–2.0 |
| Coking value (wt. % at 550° C.) | 6.0–18.0 |
| Asphaltene (n-heptane insoluble), % | 0.1–12.0 |
| Toluene insolubles (0.35μ), % | 0.010–1.0 |
| Number average mol. wt. | 220–290 |
| Elemental Analysis | |
| Carbon, % | 88.0–90.32 |
| Hydrogen, % | 7.74–7.40 |
| Oxygen, % | 0.10–0.30 |
| Sulfur, % | 1.0–4.5 |
| Chemical Analysis (proton NMR) | |
| Aromatic carbon (atom %) | 54–64 |
| Carbon/hydrogen atomic ratio | 0.90–1.0 |
| Asphaltene Analysis | |
| Number average mol. wt. | 550–750 |
| Coking value, wt. % at 550° C. | 3.5–6.5 |
| Aromatic carbon (atom %) | 55–70 |
| Bureau of Mines Correlation Index (BMCI) | 120–140 |

Although the preferred feedstock in the practice of the present invention is a cat cracker bottom, it should be appreciated that commercially available petroleum pitches, such as Ashland pitches 240 or 170 obtained, for example, by thermal treating of cat cracker bottoms is contemplated to be within the general description of cat cracker bottoms employed in the practice of the present invention.

In the process of the present invention, the cat cracker bottom is first vacuum stripped by heating at elevated temperatures and under reduced pressures. For example, the cat cracker bottom is heated at temperatures in the range generally of about 270° C. to 320° C., at pressures ranging from about 0.1 to 1.0 mm Hg. Thus, in the practice of the present invention, the polynuclear aromatic oils present in the lower boiling fractions of the cat cracker bottom are removed. In general from about 70% to about 85% of the polynuclear aromatic oils containing 1, 2 and 3 aromatic rings are removed. In a particularly preferred embodiment of the present invention, however, substantially all of the distillable polynuclear aromatic oils present in the cat cracker bottom are removed during the vacuum stripping process.

After vacuum stripping the cat cracker bottom, the vacuum stripped residue will contain all of the high molecular weight components originally present in the cat cracker bottom. Indeed, the residue obtained after vacuum stripping of the cat cracker bottom generally contains from about 18% to 22% of asphaltenes as determined by n-heptane insolubles. In accordance with the practice of the present invention, at least a portion of the n-heptane insolubles, for example, at least 50%, and preferably from 70% to 100% of the heptane insolubles are separated from the vacuum-stripped cat cracker bottom.

A method for separating the asphaltenes from the vacuum stripped cat cracker bottom is to extract the residue of the vacuum stripped cat cracker bottom with paraffinic solvents, such as normal octane, isooctane, normal heptane, pet ether, white spirits and the like. Typically, the vacuum stripped cat cracker bottom containing the asphaltene will be mixed with a paraffinic solvent in a weight ratio from about 1:10 to about 1:30 and the resultant mixture will be heated with agitation typically to the boiling point of the solvent. Thereafter, the aromatic mixture is cooled to room temperature and filtered. The deasphaltenated cat cracker residue is then subjected to heat soaking, for example, at temperatures in the range of 400° C. to 460° C., or preferably at temperatures in the range of 420° C. to 440° C., to convert the material to a pitch suitable in carbon artifact manufacture. In general, heat soaking is conducted for times ranging from about 1.0 to about 10 hours, and preferably from about 2 to 6 hours. In the practice of the present invention, it is particularly preferred that heat soaking be done in an atmosphere, such as nitrogen or alternatively in a hydrogen atmosphere. Optionally, heat soaking may be conducted at reduced pressures, for example, pressures in the range of about 50 to 150 mm Hg.

Heat soaking deasphaltenated cat cracker residues in accordance with the practice of the present invention produces a material which is particularly suitable for carbon artifact manufacture. The pitch prepared in accordance with the practice of the present invention is substantially ash free. It contains a relatively small quantities of high melting point quinoline insolubles which are generally considered detrimental to carbon artifact manufacture. More importantly, the product pitch contains a substantial quantity of materials insoluble in toluene which are beneficial in carbon artifact manufacture.

It is disclosed, for example, in U.S. Pat. No. 4,208,267 that toluene insoluble fraction of a carbonaceous graphitizable pitch is particularly useful in carbon artifact manufacture, since it exhibits a softening range and viscosity suitable for spinning and has the ability to be converted rapidly at temperatures in the range of generally about 230° C. to about 400° C. to an optically anisotropic deformable pitch containing greater than 75% of an optically anisotropic structure.

In any event, the pitch in the practice of the present invention can be utilized in the formation of coke, carbon electrodes and the like, as well as in carbon fiber manufacture. In the instance of carbon fiber manufacture, however, it is particularly preferred to isolate that fraction of the deasphaltenated heat soaked cat cracker bottom which is readily convertible into a deformable optically anisotropic phase. The preferred technique for isolating that fraction of the pitch is set forth in U.S. Pat. No. 4,208,267, which patent is incorporated herein by reference. Basically, that process requires treatment of the pitch with the solvent system which consists of a solvent or mixture of solvents that has a solubility parameter of between 8.0 and 9.5 and preferably between about 8.7 and 9.2 at 25° C. The solubility parameter of a solvent or mixture of solvents is given by the expression $$\alpha = \left(\frac{H_v - RT}{V}\right)^{\frac{1}{2}}$$

where $H_v$ is the heat of vaporization of material, R is the molar gas constant, T is the temperature in degrees K, and V is the molar volume.

In this regard, see, for example, J. Hildebrand and R. Scott, "Solubility of Non-Electroylytes," 3rd Edition, Reinhold Publishing Company, New York (1949), and "Regular Solutions," Prentice Hall, New Jersey (1962). Solubility parameters at 25° C. for hydrocarbons and commercial $C_6$ to $C_8$ solvents are as follows: benzene, 8.2; toluene, 8.9; xylene, 8.8; n-hexane, 7.3; n-heptane, 7.4; methylcyclohexane, 7.8; biscyclohexane, 8.2. Among the foregoing solvents, toluene is preferred. Also, as is well known, solvent mixtures can be prepared to provide a solvent system with the desired solubility parameter. Among mixed solvent systems, a mixture of toluene and heptane is preferred having greater than about 60 volume % toluene, such as 60% toluene/40% heptane and 85% toluene/15% heptane.

The amount of solvent employed will be sufficient to provide a solvent insoluble fraction capable of being thermally converted to greater than 75% of an optically anisotropic material in less than 10 minutes. Typically the ratio of solvent to pitch will be in the range of about 5 ml to about 150 ml of solvent to a gram of pitch. After heating the solvent, the solvent insoluble fraction can be readily separated by techniques such as sedimentation, centrifugation, filtration and the like. Any of the solvent insoluble fraction of the pitch prepared in accordance with the process of the present invention is eminently suitable for carbon fiber production.

Also it should be appreciated that in the practice of the present invention it may be necessary to treat the pitch prepared from the cat cracker bottom in such a manner so as to remove the quinoline insoluble components generated during the heat soaking. A particularly preferred technique for removing these components is disclosed in co-pending application Ser. No. 29,760 filed Apr. 13, 1979, which application is incorporated herein by reference. Basically, the heat soaked pitch is fluxed, i.e., it is treated with an organic liquid in the range, for example, of from about 0.5 parts by weight of organic liquid per weight of pitch to about 3 parts by weight of fluxing liquid per weight of pitch, thereby providing a fluid pitch having substantially all quinoline insoluble material suspended in the fluid in the form of a readily separable solid. The suspended solid is then separated by filtration or the like and the fluid pitch is then treated with the antisolvent compound so as to precipitate at least a substantial portion of the pitch free of quinoline insoluble solids.

The fluxing compounds suitable in the practice of the present invention include tetrahydrofuran, toluene, light aromatic gas oil, heavy aromatic gas oil, tetralin and the like. The antisolvent preferably will be one of the solvents or mixture of solvents which have the solubility parameter between 8.0 and 9.5, preferably between about 8.7 and 9.2 at 25° C. as discussed hereinabove.

A more complete understanding of the process of this invention can be obtained by reference to the following examples which are illustrative only and are not meant to limit the scope thereof which is fully disclosed in the hereafter appended claims.

EXAMPLE 1

A cat cracker bottom having the following physical inspections was used:

Physical Characteristics: Viscosity cst at 210° F.=10.0, Ash content, wt. %=0.050, Coking value (wt. % at 550° C.)=8.0, Asphaltene (n-heptane insolubles), %=1.0, Toluene insolubles (0.35μ), %=0.100, Number average mol. wt.=285.

Elemental Analysis: Carbon, %=90.32, Hydrogen, %=7.40, Oxygen, %=0.10, Sulfur, %=2.0.

Chemical Analysis (by proton NMR): Aromatic carbon (atom %)=65, Carbon/hydrogen atomic ratio=1.01.

Asphaltene Analysis: Number average mol. wt. (GPC)=650, Coking value (at 550° C.), %=44.0.

Bureau of Mines Correlation Index=120.

The cat cracker bottom was charged into a reactor which was electrically heated and equipped with a mechanical agitator. The cat cracker bottom was then distilled and the following fractions were collected:

| FRACTION NO. | FRACTION BOILING RANGE (°C./760 mm Hg) | Wt. % |
|---|---|---|
| 1 | 271–400 | 10.6 |
| 2 | 400–427 | 25.9 |
| 3 | 427–454 | 9.2 |
| 4 | 454–471 | 11.3 |
| 5 | 471–488 | 12.4 |
| 6 | 488–510 | 11.3 |
| 7 (Residue) | 510+ | 19.1 |

The resultant vacuum stripped cat cracker bottom or residue was employed in the subsequent examples.

EXAMPLE 2

1,000 grams of the vacuum stripped residue obtained from Example 1 was mixed with 20,000 grams of n-heptane in a large vessel equipped with an agitator and a condensor. The mix was heated to reflux with agitation for 1 hour and allowed to cool under a nitrogen atmosphere. The asphaltene was then separated by filtration using a Buckner filter and Whatman filter paper No. 40. The filtrate which contained the solvent and the asphaltene-free cat cracker residue was then vacuum stripped to remove the heptane. Yield of residue was 800 grams (or 80%).

EXAMPLES 3 AND 4

In each of the examples which follow, 800 grams of material obtained in accordance with the procedures set forth in Example 2 was introduced into an electrically heated reactor equipped with an agitator and a nitrogen inlet and a temperature control system. The feed was heated to the temperature set forth in the table below for the time set forth therein with agitation after heating. The mix was cooled to around 300° C. and the pressure was then reduced to about 4 to 5 mm Hg and the resultant mixture was heated to about 380° as a distillable part of the pitch was removed. The remaining pitch was cooled under nitrogen to room temperature.

The percent quinoline insolubles of the product was then determined by the standard technique of quinoline extraction at 75° C. (ASTM Test Method No. D-2318/76).

The toluene insoluble fraction of the pitch was determined by the following process:

(1) 40 grams of crushed sample were mixed for 18 hours at room temperature with 320 milliliters of toluene. The mixture was thereafter filtered using a 10–15 micron fritted glass filter;

(2) the filter cake was washed with 80 milliliters of toluene, reslurried and mixed for four hours at room temperature with 120 milliliters of toluene, filtered using a 10–15 micron glass filter;

(3) the filter cake was washed with 80 milliiters of toluene followed by a wash with 80 milliliters of heptane, and finally the solid was dried at 120° C. in the vacuum for 24 hours.

The optical anisotropicity of the pitch was determind by first heating the pitch to 375° C. and then after cooling, placing a sample of the pitch on a slide with Permount, a histological mounting medium sold by the Fisher Scientific Company, Fairlawn, N.J. A slip cover was placed over the slide by rotating the cover under hand pressure, the mounted sample was crushed to a powder and evenly dispersed on the slide. Thereafter the crushed sample was viewed under polarized light at a magnification factor of 200× and the percent optical anisotropicity was estimated.

The reaction conditions and the test data are given in Table II below.

TABLE II

| | Heat Soaking | | Vac. Stripping | | Pitch Analysis | | Toluene Insolubles Analysis | |
|---|---|---|---|---|---|---|---|---|
| Example | Temp. °C. | Time, Hrs. | Temp. °C. | Pressure, mm Hg | Toluene Insolubles, % | Qi, % | Melting Point, °C. | Optical Activity, % |
| 3 | 420 | 3 | 380 | 1.0 | 37.0 | 0.80 | 300–325 | — |
| 4 | 430 | 3 | 380 | 1.0 | 78.0 | 27.0 | 300–325 | 75–100 |

EXAMPLES 4 AND 5

In each of these examples, 600 grams of a vacuum stripped cat cracker bottom was introduced into a reactor and heat soaked in accordance with the procedures outlined in Examples 3 and 4 above. Thereafter, the heat soaked cat cracker bottom was vacuum stripped to remove the distillate present in the pitch and the remaining product was then cooled and the quinoline insoluble and toluene insoluble fraction was determined in accordance with the procedures outlined in Examples 3 and 4. The test conditions and the results are set forth in Table III below.

TABLE III

| | Heat Soaking | | Vac. Stripping | | Pitch Analysis | | Toluene Insolubles Analysis | |
|---|---|---|---|---|---|---|---|---|
| Example | Temp. °C. | Time, Hrs. | Temp. °C. | Pressure, mm Hg | Toluene Insolubles, % | Qi, % | Melting Point, °C. | Optical Activity, % |
| 4 | 420 | 3.0 | 380 | 6.0 | 43.5 | 7.5 | 300–325 | — |
| 5 | 430 | 3.0 | 360 | 1.0 | 75.0 | 39.5 | 300–325 | 75–100 |

EXAMPLE 6

This comparative example illustrates the significance of vacuum stripping a cat cracker bottom prior to deasphaltenating the cat cracker bottom. In this example, 100 grams of a total cat cracker bottom, i.e., a cat cracker which was not vacuum stripped, was mixed with 2000 grams of n-heptane in a large vessel equipped with an agitator and a condensor. The mix was heated to reflux with agitation for 1 hour and allowed to cool under a nitrogen atmosphere. The mixture was then separated by filtration using a Buckner filter and Whatman filter paper No. 40, and the resultant solid was dried in a vacuum at 50° C. for 10 hours. The yield was only 0.50 gram (or 0.5 wt. %). The melting point was 220° C. Thus, an insufficient yield of deasphaltenated cat cracker bottom was obtained and heat soaking of the product was not conducted.

What is claimed is:

1. A process for preparing a feedstock suitable for carbon fiber manufacture comprising the steps of:

(1) vacuum stripping a cat cracker bottom to remove from about 70 weight percent to about 85 weight percent of the polynuclear aromatic oils containing 1, 2 and 3 aromatic rings present in lower boiling fractions of said cat cracker bottom;

(2) extracting the residue of step 1 with a paraffinic solvent to remove a portion of the asphaltenes present in the vacuum stripped cat cracker bottom; and (3) heat soaking the deasphaltenated cat cracker residue obtained from step 2 to provide a feedstock suitable for carbon fiber manufacture.

2. The process of claim 1 wherein from about 70 percent to about 85 percent of the polynuclear aromatic oils are removed.

3. The process of claim 1 wherein said paraffinic solvent is heptane.

4. The process of claim 1 wherein said heat soaking is carried out at temperatures in the range of about 400° C. to about 460° C.

* * * * *